United States Patent [19]

Crawford

[11] 4,341,430

[45] Jul. 27, 1982

[54] FLAT CABLE CONNECTOR

[75] Inventor: Christopher L. Crawford, Harrisburg, Pa.

[73] Assignee: AMP Incorporated, Harrisburg, Pa.

[21] Appl. No.: 204,099

[22] Filed: Nov. 5, 1980

[51] Int. Cl.[3] ..... H01R 11/20; H01R 13/514

[52] U.S. Cl. ..... 339/99 R; 339/176 MF

[58] Field of Search ..... 339/99 R, 176 MF, 176 MP, 339/97 R, 97 P, 98, 125 R, 128, 17 F, 75 MP

[56] References Cited

U.S. PATENT DOCUMENTS

| | | | |
|---|---|---|---|
| 3,601,746 | 8/1971 | Teagno | 339/75 MP X |
| 3,879,099 | 4/1975 | Shaffer | 339/99 R |
| 3,920,303 | 11/1975 | Pittman | 339/176 MP X |
| 4,003,625 | 1/1977 | Yladic | 339/176 MP |
| 4,062,616 | 12/1977 | Shaffer et al. | 339/99 R |
| 4,128,289 | 12/1978 | Occhipinti | 339/176 MP X |
| 4,138,184 | 2/1979 | Knopp | 339/97 P |
| 4,185,882 | 1/1980 | Johnson | 339/176 MP |
| 4,209,217 | 6/1980 | Gudaitis | 339/176 MF X |

*Primary Examiner*—John McQuade
*Assistant Examiner*—John S. Brown
*Attorney, Agent, or Firm*—Gerald K. Kita

[57] ABSTRACT

The invention is a hinged electrical connector for terminating conductors of flat cable, using finger pressure to close the hinged parts of the connector over the cable.

5 Claims, 7 Drawing Figures

FLAT CABLE CONNECTOR

FIELD OF THE INVENTION

The present invention relates to electrical connectors for terminating conductors of flat cable, and is directed to a hinged connector using finger pressure to close the hinged parts thereof over the cable, penetrating electrical terminals into the cable to establish electrical connections with the cable conductors.

BACKGROUND OF THE PRIOR ART

Flat cable comprises an array of parallel insulation covered wires or conductors interconnected by a web of insulation material which maintains the conductors in the array. Electrical connectors for flat cable comprises electrical terminals contained in an insulation housing which is closed over the cable. One such connector, as disclosed in U.S. Pat. No. 4,160,573 requires stripping the insulation from the cable, leaving exposed portions of the cable conductors to be terminated by electrical contacts in the connector. Another type connector, as disclosed in U.S. Pat. No. 3,820,055 does not require stripping. However, a force applying tool, such as an arbor press, is necessary to press the unstripped cable against sharpened ends of the terminals so that the terminals penetrate the cable.

SUMMARY OF THE INVENTION

The connector of the present invention does not require stripping of the cable, nor a force applying press to penetrate terminals into the cable. Only finger pressure is needed to pivot one part of the connector toward another containing the terminals. Sufficient mechanical advantage is obtained by finger pressure on the pivoted parts, to penetrate the terminals into the unstripped cable and establish electrical connections with the conductors.

A base portion of the connector contains the terminals and is provided with an arcuate wall. A holder portion of the connector holds the unstripped cable, and is slidable along the arcuate wall to pivot the cable against and into conductor terminating portions of the terminals.

OBJECTS

An object of the invention is to provide a hinged electrical connector for terminating conductors of flat cable, with finger pressure being sufficient to close the hinged parts of the connector and penetrate electrical terminals into the cable to terminate the conductors.

Another object of the invention is to provide an electrical connector with a holder portion which is mounted to slide along an arcuate wall of a base portion and pivot a flat cable into wire terminating portions of electrical terminals.

Another object of the invention is to provide an electrical connector of compact size and capable of assembly onto a flat cable without the use of special tools.

Other objects and advantages of the present invention will become apparent from the following detailed description taken in conjunction with the drawings.

DETAILED DESCRIPTION

Figure 1:
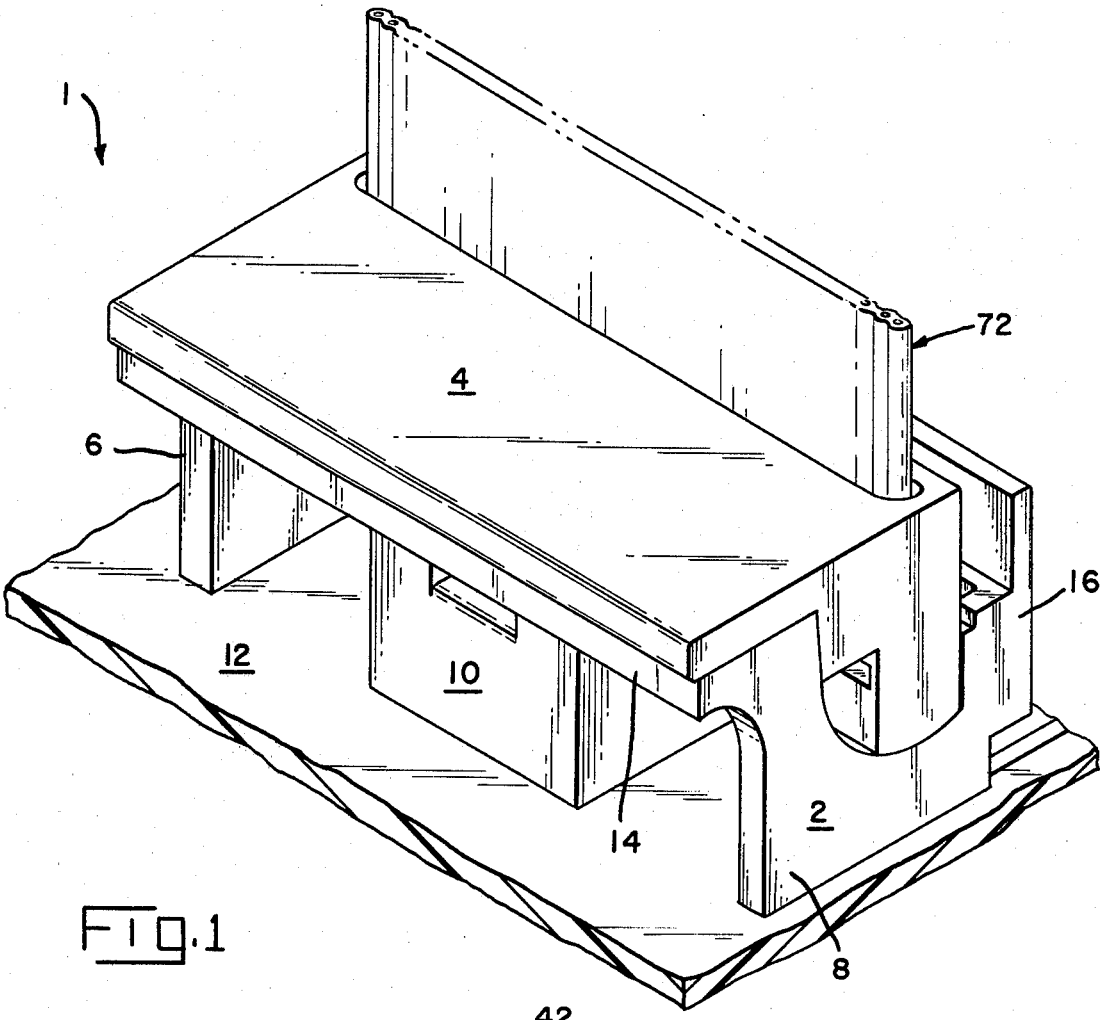
FIG. 1 is an enlarged fragmentary perspective of a preferred embodiment of a connector assembled on a flat cable and mounted on a circuit board.
Figure 2:
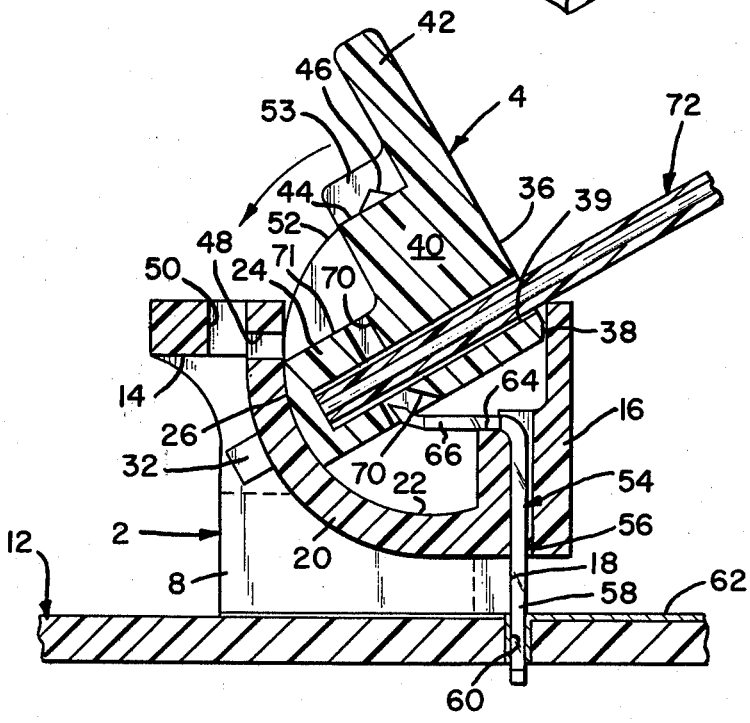
FIGS. 2 and 3 are sections taken along the lines 3—3 of FIG. 5 and illustrate the assembly procedure for the connector of FIG. 1.
Figure 3:
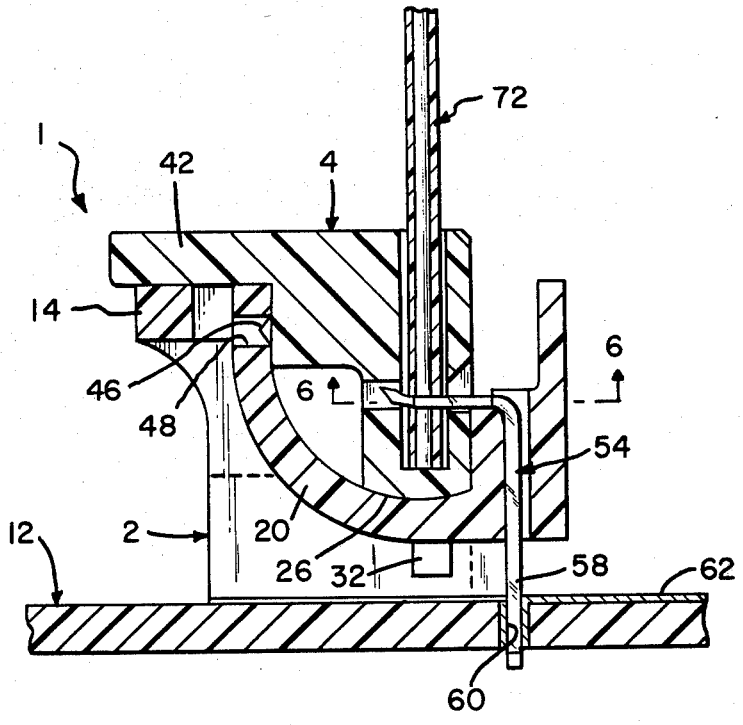

An electrical connector is shown generally at 1 in FIGS. 1-3 and comprises a base 2 and a holder 4, each of unitary molded, rigid plastic construction. FIG. 1 shows the base 2 as having outer pillars 6 and 8 spaced from a central pillar 10. The bottoms of the pillars are coplanar for mounting against a circuit board 12. The pillars adjoin a lip flange 14 projecting parallel to and spaced from the pillar bottoms. The pillars adjoin a thickened back wall 16, the bottom of which rests against the board 12. An undercut rectangular recess 18 is provided along the length of the wall 16. The pillars adjoin an arcuate wall 20 which connects the flange 14 and the wall 16. The outer obverse surface of the wall 20 is spaced from the bottoms of the pillars. The inner surface of wall 20, together with flange 14 and wall 16, define a channel 12 which receives the holder 4.

Figure 7:
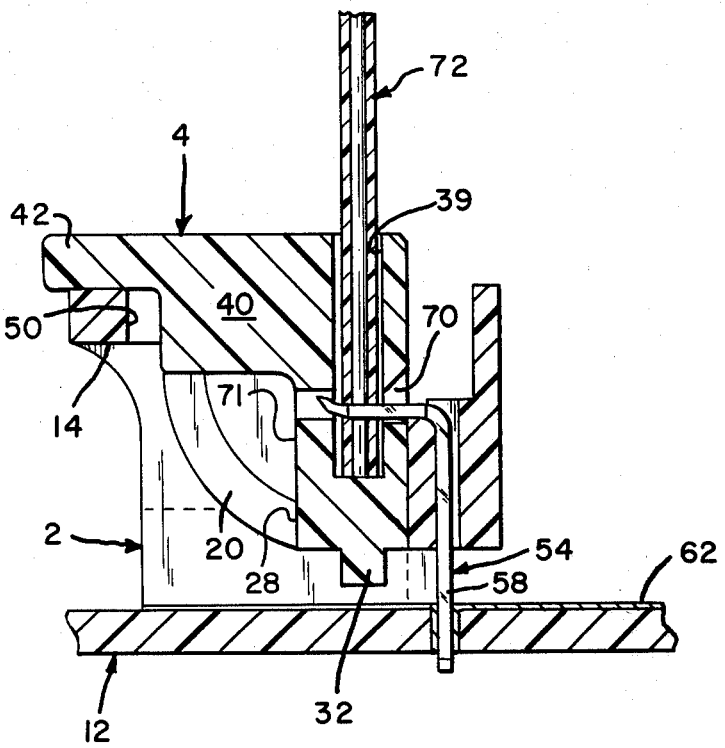
FIG. 7 is a section along line 7—7 of FIG. 5.

Holder 4 is shown in FIGS. 2 and 7 and includes thickened portion 24 having arcuate shoulders 26 defined at the intersection of arcuate projecting ribs 28 with the remainder of portion 24. Stems 28 project through slots 30 which extend along the wall 20. A widened head 32 on each rib 28 is inserted through an opening 34 provided in the flange 14 and in communication with an end of a slot 30. Thereafter, as the ribs 28 slide along the slots 30, the heads 32 slidably overlie the obversely curved side of the wall 20 and retain the holder 4. As shown in FIG. 2, an opposite end 36 of the portion 24 has a chamfer 38 that abuts flatly against wall 16 and latchingly retains the holder against and between walls 16 and 20 at a desired initial orientation. End 36 includes an open, deeply slotted passageway 39 extending linearly toward the end 26. Another thickened portion 40 of holder 4 is provided with a lever 42 projecting transversely of the passageway 39 and in alignment with the end 36. A surface 44 under the lever 42 is provided with one or more double ramped, wedge shaped projections 46. An opening 49 extends partially in wall 20 and in flange 14 to latchably receive a respective projection 46 to retain the holder in its position shown in FIG. 3. Opening 50 through flange 14 is formed during molding by a core pin which assists in molding the opening 48.

An outer arcuate surface of a wall 52 extend between and merge with surface 44 and each shoulder 26. Projecting outwardly of surface 44 and flange 14 is a guide and alignment flange 53 aligned with a respective rib 28 and inserted into a respective slot when holder 4 is pivoted to its position shown in FIG. 3.

Figure 5:
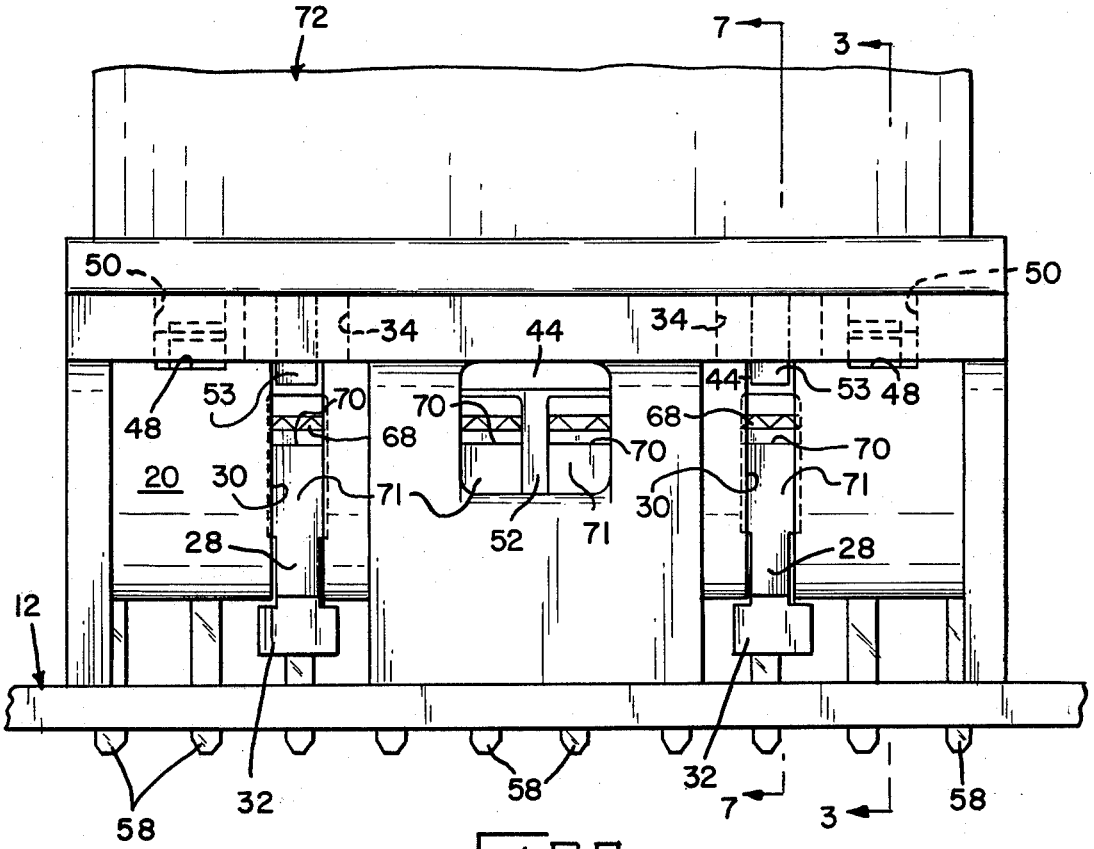
FIG. 5 is a side elevation of the connector shown in FIG. 1.
Figure 6:
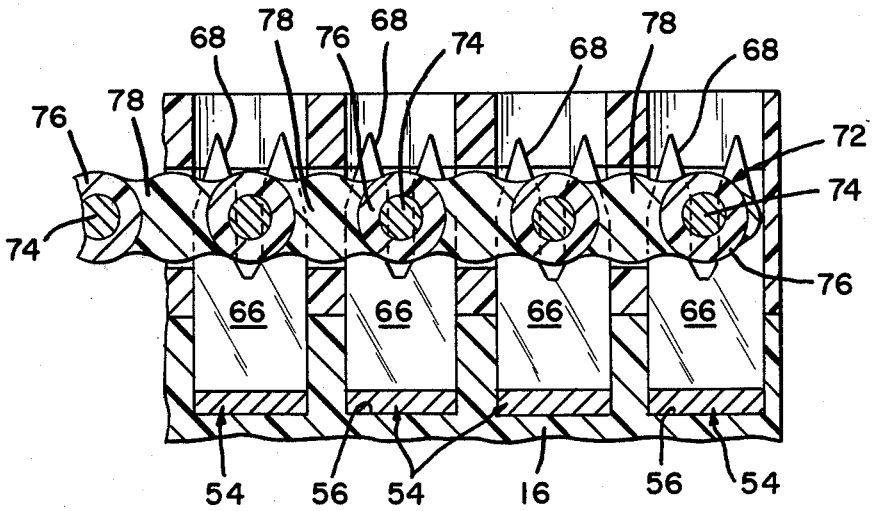
FIG. 6 is an enlarged section taken generally along the line 6—6 of FIG. 3.

FIGS. 2 and 5 show a plurality of electrical terminals 54, frictionally locked in recesses 56 in wall 16. Electrical lead portions 58 of the terminals project from recesses 56 and impinge against a side of recess 18, which is parallel to the external side of wall 16, and pluggably insert within plating lined apertures 60 of the circuit board 12. The plating also provides circuit traces or paths 62 over the circuit board 12. The terminals are bent, transversely of their lengths, over shoulders 64 of the wall 16 and provide wire in slot type, conductor terminating portions 66 projecting into the channel 22.

More specifically, each portion 66 includes a conductor receiving and terminating slot 68 bifurcating a sharpened end which enters a respective terminal receiving cavity 70 which extends across passageway 39 and merges into a respective enlarged recess 71 between ribs inset in wall 52. Each portion 66 is curved to project approximately along an arcuate course concentrically of wall 20.

FIGS. 2, 3 and 5 illustrate a flat cable 72 with conductors 74 in respective sheaths 76 of insulation joined together by webs 78 of insulation. An end of the cable is inserted into the passageway 39 the surfaces of which hold the cable flat. The end of the cable, as shown in FIG. 2, must extend beyond the cavities 70 to insure penetration by the terminal portions 66. Finger pressure is applied to lever 42, pivoting the lever toward flange 14, overcoming the locking effect of chamfer 38, and pivoting holder 4 from a position shown in FIG. 2 to a position shown in FIG. 3. As a result, the sharpened ends of terminal portions 66 traverse along cavities 70 and across the passageway 39 penetrating the cable. Also, as shown in FIG. 5, the conductors are received along slots 68 of terminal portions 66. The sides of the slots from resilient jaws which grip the conductors and establish electrical connection therewith.

The holder 4 is slidably guided by wall 20 to pivot cable 72 along an arcuate curvilinear course, and about an axis of concentricity for the course and the wall 20. The lever 42 extends radially further than the distance of the terminal portions 66 from the axis. Thereby, force applied to lever 42, using only finger pressure, is multiplied to penetrate the terminal portions 66 into and across the unstripped cable. The projection 46 latches in opening 48 to maintain holder 14 in position as shown in FIG. 3, with lever 42 stopped against flange 14 and portion 24 stopped against wall 16. To release the holder, a screwdriver blade may be inserted under flange 14 and into each opening 48 to push out a respective projection 46.

Figure 4:
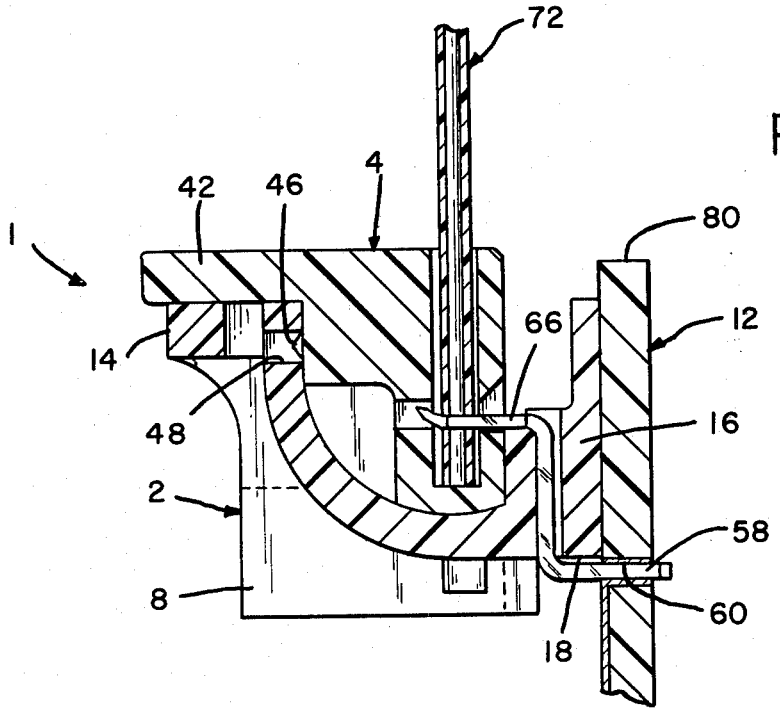
FIG. 4 is a view similar to FIG. 3 with the connector mounted with a different orientation on a circuit board.

FIG. 4 illustrates the connector 1 in an alternative mounting with wall 16 supported on the circuit board 12 close to an edge 80 thereof. The terminal portions 58 are bent over against a side of the recess 18, and project perpendicular to wall 16.

Although a preferred embodiment of the invention has been disclosed, other embodiments and modifications thereof which are apparent to one of ordinary skill are intended to be covered by the spirit and scope of the appended claims.

What is claimed is:

1. A connector for flat cable, comprising:

a base, a holder pivoted to said base and provided with a passageway constructed to receive multiple conductors of a flat cable, multiple electrical terminals on said base with terminal portions projecting externally of said base and conductor terminating portions projecting toward said passageway, said base including an arcuate wall slidably cooperating with said holder upon pivoting said holder passageway in a curvilinear course into said terminating portions, and, said holder including a projection slidable along a slot in said arcuate wall, said projection having an enlarged head slidable along said arcuate wall.

2. The structure as recited in claim 1, wherein, said holder includes first latch means engaging said base with said terminating portions projecting toward but not projecting across said passageway, and second latching means engaging said base with said terminating portions extending across said passageway.

3. The structure as recited in claim 1 or claim 2, wherein, said base includes a flange, said holder includes a lever portion pivotable toward and into abutment with said flange.

4. The structure as recited in claim 1, wherein contacts project from an external first side of said base parallel to an external second side of said base.

5. The structure as recited in claim 1, wherein, said terminating portions are curved along said course.

* * * * *